US009896268B1

(12) United States Patent
Crowley, Jr.

(10) Patent No.: US 9,896,268 B1
(45) Date of Patent: Feb. 20, 2018

(54) MULTITRACK STORAGE SYSTEM FOR OPEN CRAWL SPACE

(71) Applicant: Wallace J Crowley, Jr., Lebonan, NJ (US)

(72) Inventor: Wallace J Crowley, Jr., Lebonan, NJ (US)

( * ) Notice: Subject to any disclaimer, the term of this patent is extended or adjusted under 35 U.S.C. 154(b) by 0 days.

(21) Appl. No.: 15/530,599

(22) Filed: Feb. 6, 2017

(51) Int. Cl.
*B65G 1/04* (2006.01)
*B61B 13/08* (2006.01)

(52) U.S. Cl.
CPC ..... *B65G 1/0492* (2013.01); *B61B 13/08* (2013.01)

(58) Field of Classification Search
CPC ..... B65G 1/08; B65G 1/133; E04H 13/006
USPC ..... 414/276, 286, 267, 268, 272, 280, 281, 414/359, 389; 52/134, 29, 31, 33; 104/35, 45
See application file for complete search history.

(56) References Cited

U.S. PATENT DOCUMENTS 4,203,368 A 5/1980 Haskins
4,347,791 A 9/1982 Mandros
4,372,451 A 2/1983 Rasmussen
4,966,513 A * 10/1990 Motoda ..... B65G 1/02 414/277
6,202,359 B1 * 3/2001 Reed ..... A47B 51/00 312/268
7,980,181 B2 7/2011 Heaslip et al.
8,578,859 B1 * 11/2013 Roy ..... B61B 12/10 104/140
8,641,354 B2 * 2/2014 Tokuyama ..... B65G 1/04 414/253
8,893,623 B2 11/2014 Gordon
2005/0038575 A1 2/2005 Wu
2014/0015223 A1 1/2014 Banwart
2016/0347544 A1 * 12/2016 Kvifte ..... E06C 9/08

* cited by examiner

*Primary Examiner* — Mark C Hageman

(57) ABSTRACT

A multitrack storage system for open crawl space includes: a) different sets of tracks for guiding separate, wheeled storage bins, wherein the tracks have a proximal and a distal end; b) a bumper at the distal end of each set of tracks to prevent off track movement; c) separate, wheeled storage bins, each storage bin having a plurality of bottom wheels and a plurality of side wheels, and nests on the track base; d) a bin movement mechanism connected to at least one separate, wheeled storage bin for movement; e) a proximal end for different sets of tracks, wherein the tracks terminate adjacent one another in a predetermined pattern; f) a drop down gate for access to different sets of tracks; wherein a user may store items in the wheeled storage bins and move the storage bins along different sets of tracks away from the central terminus for storage.

16 Claims, 14 Drawing Sheets

MULTITRACK STORAGE SYSTEM FOR OPEN CRAWL SPACE

REFERENCE TO RELATED APPLICATIONS

The present application is a continuation-in-part application of copending U.S. patent application Ser. No. 15/330,440, by the same inventor herein, namely, Wallace J. Crowley, Jr., filed on Sep. 22, 2016 titled "MULTITRACK STORAGE SYSTEM WITH CENTRAL TERMINUS".

BACKGROUND OF INVENTION a. Field of Invention

The present invention relates to storage systems for personal, business or commercial use, wherein a plurality of single groove tracks run parallel to one another and initiate with gates (doors) that open downwardly and have corresponding tracks. The storage containers are arranged as a plurality of wheeled storage containers that may be removably connected to one another, and the tracks may be non-horizontal to provide gravity assisted movement in a single direction. Movement in the opposite direction may be motorized, but is preferably accomplished manually. These systems may be used in any environment, but are particularly adaptable to difficult access areas, such as crawl spaces under decks, elevated structures and particularly for storage under mobile homes.

b. Description of Related Art

The following patents are representative of the field pertaining to the present invention:

U.S. Pat. No. 8,893,623 B2 to Gordon describes a multi-track multi-vehicle coaster that simulates a popular theme of a competition, struggle or conflict taken from history or fiction. The vehicles interact with each other and interact with the ride scenery in many different ways. The vehicle velocity is altered at different points in the ride using multiple motors and brakes. An interactive queue is provided and allows people in the queue to interact with people on the ride. Energy recycling and computer ride control are also disclosed.

U.S. Pat. No. 7,980,181 B2 to Heaslip et al. describes a drag racing roller coaster amusement ride that has at least two sets running rails, each set having at least one running rail and an embark point. At least two carriers (109) are arranged to carry at least one rider on a respective set of running rails with the rider(s) in a substantially prone position. Each carrier is arranged to slidingly engage with the respective set of running rails to enable the carriers to traverse the ride. The ride has an indicator (109) to provide a ride commencement indication. A launch system is configured to provide a powered initial motion to each carrier. Each carrier has a ride activator controllable by a rider of the carrier to trigger the launch system to commence the ride for the carrier following the ride commencement indication. Launch systems are also disclosed.

U.S. Pat. No. 4,372,451 to Rasmussen et al. describes a gravity-feed merchandise storage and delivery rack that includes upstanding support columns and a plurality of vertically-spaced storage shelves mounted upon the support columns by means of mounting clips; each storage shelf includes rearward and forward side frame members interconnected by splice members including offset portions so that the forward side frame member is offset outwardly with respect to the rearward side frame member to facilitate passage of merchandise thereby; an intermediate guide member on the storage shelf having a pin adjustably positioned thereon and extending downwardly therefrom to engage in openings in a channel member extending transversely of the storage shelf; and a shelf support infinitely adjustable upon an intermediate support column for supporting an elongated storage shelf intermediate the front and rear thereof.

U.S. Pat. No. 4,347,791 to Mandros describes a guideway system for cargo including vehicles is provided wherein a carriage glides on a rail mounted in a channel. The rail has compressed air discharge ports and vacuum intake ports positioned longitudinally therealong. The compressed air ports emit sufficient air to provide an air support cushion under the carriage and to impart positive air pressure behind it while the vacuum ports reduce the air pressure forward of the carriage to create an air pressure differential that propels the carriage along such rail. Vehicles drive onto a carriage, are secured in place and are conveyed to a desired station on such carriage. The vehicle then unloads from the carriage and drives off to its final destination. Similarly, other cargo is loaded onto a carriage and unloaded at its destination. In another embodiment, the carriage has a longitudinal slot in its underbody adjacent its support rail and compressed air is discharged from ports in the rail at the forward portion of the slot to propel the carriage along the rail.

U.S. Pat. No. 4,203,368 to Haskins describes an apparatus for moving loads from one position to another, employing an arrangement of a plurality of loop and/or spur tracks supported from above and having terminals converging in a direction of a pivot point having secured thereat a radial transfer track having a free swinging end adapted to couple with any of the loop and/or spur tracks to effect transfer of a hoisted load supported on one of the tracks, to another track via the radial transfer track. The radial transfer track is supported, adjacent its swinging end, on an arcuate support track which is concentric to an arcuate line passing through all of the converging terminals of the loop and/or spur tracks.

United States Patent Application Publication No. 2014/0015223 A1 to Banwart describes a powered converter trolley for movement and attachment of trailers that is provided. The trolley comprises a conventional converter trolley having a drawbar. The trolley has a power supply and operates as a towing device. The trolley connects to a freight trailer and can be raised or lowered from a stored position to a ground-engaging, working position. Alternatively, the wheels of the trolley may be powered for providing motion to the trolley. The trolley further comprises several attachment devices for securing the trolley to an intermodal railcar, including alternative hydraulic, mechanical, and electrically-powered tie down devices. A trolley movable along a railcar is provided for securing the trolley or trailer to the railcar and includes a hitch component for selectively interconnecting to a hitch component on the trolley or trailer.

United States Patent Application Publication No. 2005/0038575 A1 to Wu describes an autonomous personal transportation system for moving passengers and light freights which is constructed with a track network and small vehicles on the track network. There are a number of stations and stops for loading and unloading on side tracks off the mainline of the track network. The vehicle width is limited to a dimension for one seat. The vehicles can be coupled statically or dynamically to form a train. The track has side rails for the rigid wheels of the vehicle and a central rail for centering the vehicle on the guideway and providing additional acceleration and braking capability. The control system for the movement of vehicles is divided into three levels: the central control system, the wayside control system and the vehicle control system.

Notwithstanding the prior art, the present invention is neither taught nor rendered obvious thereby.

SUMMARY OF INVENTION

The present invention relates to a multitrack storage system for open crawl space. By open crawl space is meant an area under a structure that is not a basement. It is open in that it has no closed solid walls and/or floor, but when the present invention system is installed it is anticipated to be enclosed crawl space. The present invention multitrack storage system includes: a) a plurality of different sets of tracks with a track base and opposing sidewalls for guiding a plurality of separate, wheeled storage bins, wherein each of the tracks constitute a groove with a predetermined width of at least X, wherein X is a width in the range of about six inches to about eight feet, and preferably two to about five feet, and has connection mechanisms for connecting the tracks to one another, where the tracks have a proximal end and a distal end; b) a distal end bumper at the distal end of each of the sets of tracks to prevent off track movement of any of the storage bins that may be moved thereon; c) the plurality of separate, wheeled storage bins, positioned on the different sets of tracks, each storage bin has a plurality of bottom wheels and a plurality of side wheels wherein the maximum outside width of the bins, including the side wheels, as measured side to side, is less than X such that the side wheels of the storage bins nest in the tracks, the storage bin side wheels having a non-vertical axis of rotation within the range of minus 45 degrees to plus 45 degrees from horizontal, and nesting on the track base; d) a bin movement mechanism connected to at least one separate, wheeled storage bin for movement thereof; e) a proximal end for the plurality of different sets of tracks wherein the plurality of different sets of tracks terminate adjacent one another in a predetermined pattern of set of tracks; and f) a drop down gate for opening and closing access to the plurality of different sets of tracks, the gate having a front and a back, wherein when the gate is closed it is up and the back faces the plurality of different sets of tracks, and when the gate is down and open, the back faces upwardly; the back having a plurality of short tracks, at least a portion, which is in alignment with, the predetermined patterns of sets of tracks; wherein a user may store items in the wheeled storage bins and place the wheeled storage bins on the short tracks of the dropdown gate, and then move the storage bins along one of the plurality of different sets of tracks away from the drop down gates for storage.

In some embodiments of the present invention multitrack storage system, the plurality of different sets of tracks is parallel to one another.

In some embodiments of the present invention multitrack storage system, the storage system pattern includes a tilting mechanism in contact with at least a portion of the tracks, the tilting mechanism being adjustable to alter the angle of the tracks to a non-horizontal position.

In some embodiments of the present invention multitrack storage system, the tilting mechanism is selected from the group consisting of: (a) a ratcheted frame; (b) a lever jack; (c) a screw jack; (d) an adjustable wedge; and (e) a fixed wedge.

In some embodiments of the present invention multitrack storage system, the tilting mechanism is a plurality of adjustable height stilts connected to the tracks.

In some embodiments of the present invention multitrack storage system, the tracks have vertical sidewalls.

In some embodiments of the present invention multitrack storage system, the tracks have sidewalls angled outwardly from the base at angles in excess of 90 degrees.

In some embodiments of the present invention multitrack storage system, the wheeled storage bins include lids.

In some embodiments of the present invention multitrack storage system, the tracks are structurally formed of materials selected from the group consisting of wood, metal, plastic and combinations thereof.

In some embodiments of the present invention multitrack storage system, the bin movement mechanism includes at least one flexible cord with a distal end away from the drop down gate and a proximal end at the adjacent drop down gate.

In some embodiments of the present invention multitrack storage system, each storage bin has a distal end away from the drop down gate and a proximal end closest to the drop down gate, and the at least one flexible cord is connected to the distal end of the bin and there is a pulley at the distal end of the track whereby the cord travels from the distal end of the storage bin to the pulley and then returns to the drop down gate.

In some embodiments of the present invention multitrack storage system, the storage bin has a distal end away from the drop down gate and a proximal end closest to the drop down gate, and the at least one flexible cord is connected to the proximal end of the bin and travels from the proximal end of the storage bin to the drop down gate.

In some embodiments of the present invention multitrack storage system, the storage bins further include side wheels with a non-horizontal axis of rotation within the range of minus 20 degrees to plus 20 degrees from horizontal.

In some embodiments of the present invention multitrack storage system, the side wheels have a vertical axis of rotation.

In some embodiments of the present invention multitrack storage system, the bin movement mechanism is a motorized bin movement mechanism.

In some embodiments of the present invention multitrack storage system, the motorized bin movement mechanism includes a transmitter and a receiver and is wirelessly operable.

In some embodiments of the present invention multitrack storage system, the plurality of different sets of tracks includes at least one set of tracks at a first level, being a first floor level, and at least one set of tracks at a second level, being a second floor level.

In some embodiments of the present invention multitrack storage system, the multitrack storage system further includes at least one bin transporting elevator lift to move the storage bins from the first floor level to the second floor level and vice versa.

In some embodiments of the present invention multitrack storage system, the elevator lift includes a tray and a power winch.

In some embodiments of the present invention multitrack storage system, the elevator lift is laterally moveable from one set of tracks to another set of tracks.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
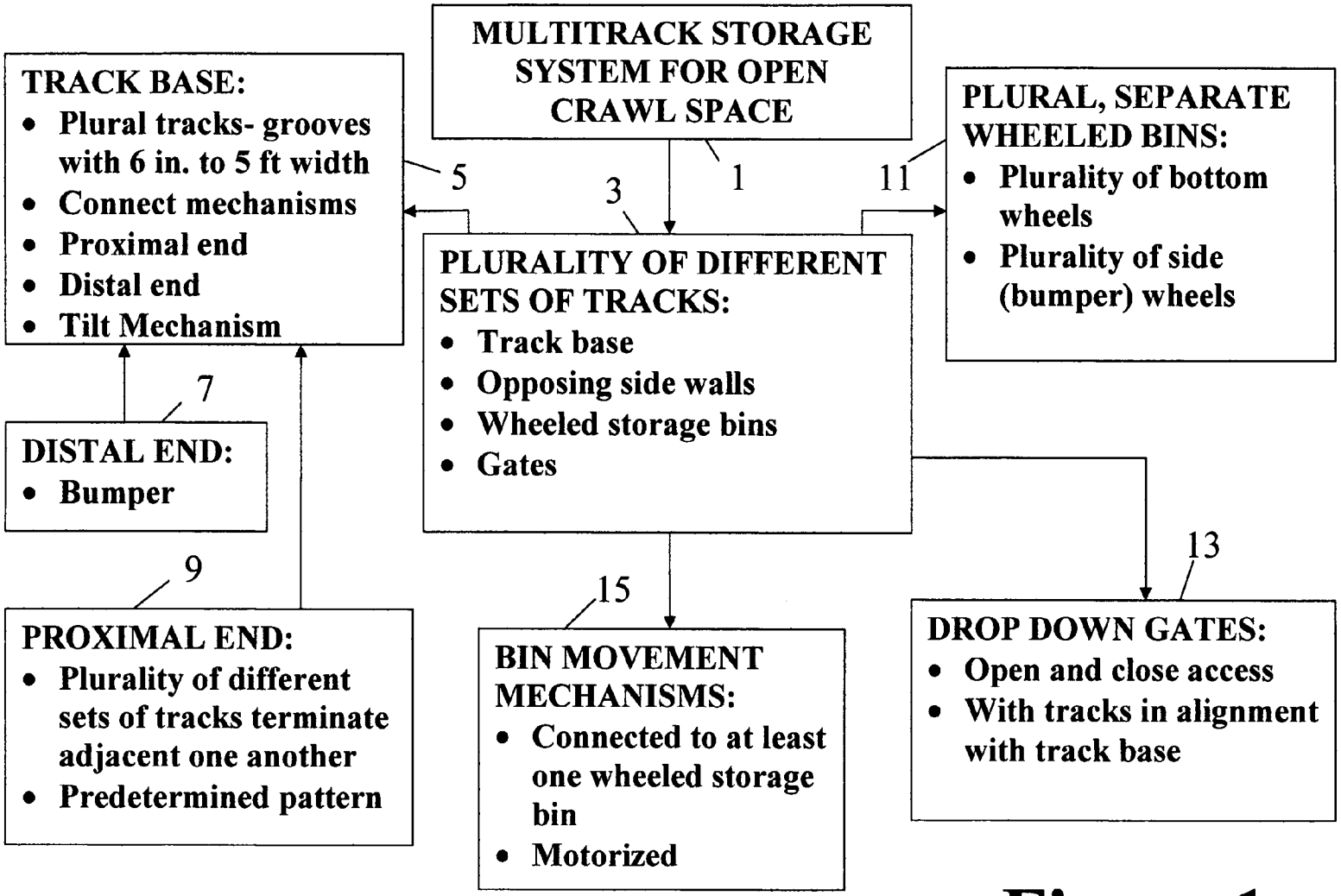
FIG. 1 is a block diagram showing some of the features and options of the present invention multitrack storage system.

Referring now in detail to the drawings wherein like reference numerals designate corresponding parts throughout the several views, various embodiments of the present invention are shown. By way of definition, the terms "track", "tracks" and "multitrack" refer to guideway(s) that have sufficient flat pathways to accommodate free moving wheeled cargo and storage containers referred to herein as "bins". These words are not intended to mean railroad tracks, but rather open roadway of pathway sections. These present invention tracks have side rails, intended to act as bumpers for the bins. Thus, the tracks have main bases (bottoms), and side rails that deflect and guide moving bins. They typically have an open (proximal) end and a blocked or bumper (distal) end.

FIG. 1 is a block diagram of some embodiments of the present invention, setting forth the parameters of some present invention multitrack storage system for open crawl space. It includes block 1 multitrack storage system for open crawl space; block 3 plurality of different sets of tracks including track base, opposing side walls, wheeled storage bins and gates; and block 5 track base including plural tracks—grooves with 6 inch to 5 feet width, connect mechanisms, proximal end and distal end. It further includes block 7 distal end with bumper and block 9 proximal end including a plurality of different sets of tracks terminating adjacent one another in a predetermined pattern. It also includes block 11 plural, separate wheeled bins that include a plurality of bottom wheels and a plurality of side (bumper) wheels; block 13 drop down gates that open and close access, with tracks in alignment with the track base; and block 15 bin movement mechanisms that are connected to at least one wheeled storage bin.

Figure 2:
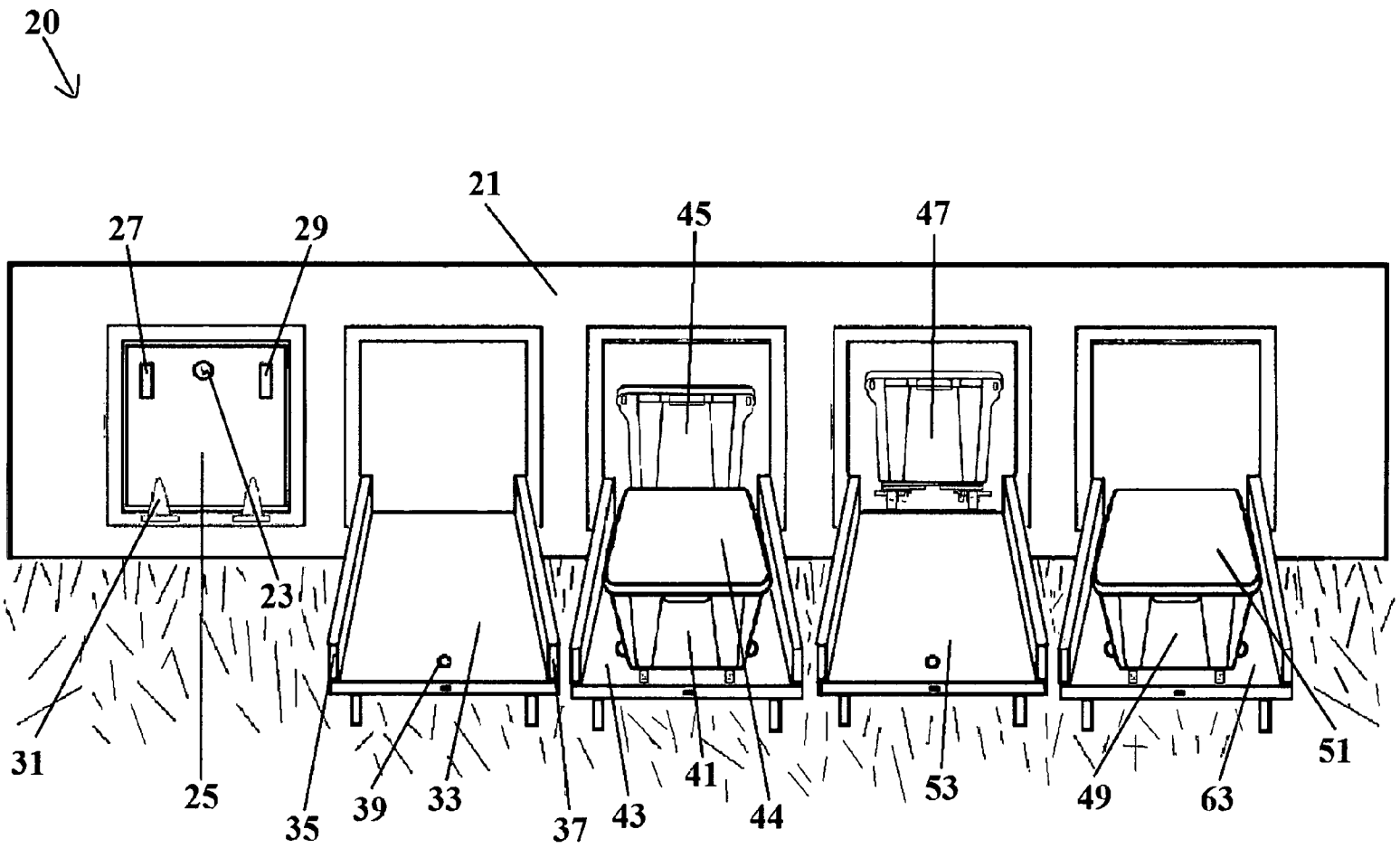
FIG. 2 illustrates a front view of one potential layout arrangement of a present invention multitrack storage system.

FIG. 2 illustrates a front view of one potential layout arrangement of a present invention multitrack storage system 20. In this Figure, it does not show a structure above the front wall 21, but wall 21 would be the lower portion of an otherwise open or closed off area below a structure, such as a micro home, mobile home or house deck. Wall 21 may be any known wall structure, with five openings (entranceways), one for each drop down gate and track, as shown. Here, there are drop down gates 25, 33, 43, 53 and 63. These gates are hinged so as to perform the dual function of a lockable door when closed and a track extension when open. Gate 25 is closed and locked by a deadbolt lock 23 (which could alternatively be a tumble lock, a combination lock, a fingerprint recognition lock, a wireless lock or any other lock). It includes handles 27 and 29 that act also as base supports, such as in the case of adjacent drop down gate 33. It also includes hinges, such as hinge 31. Open gate 33 has rails 35 and 37 as shown, as well as lock mechanism 39. Open gate 43 has one bin 41, with lid 44, positioned to roll up or down (in or out of storage) and behind bin 41 is stored bin 45. Open gate 53 shows bin 47 in storage and open gate 63 shows bin 49 with lid 51 on gate 63. The following Figures illustrate further details of present inventions multitrack storage systems.

Figure 3B:
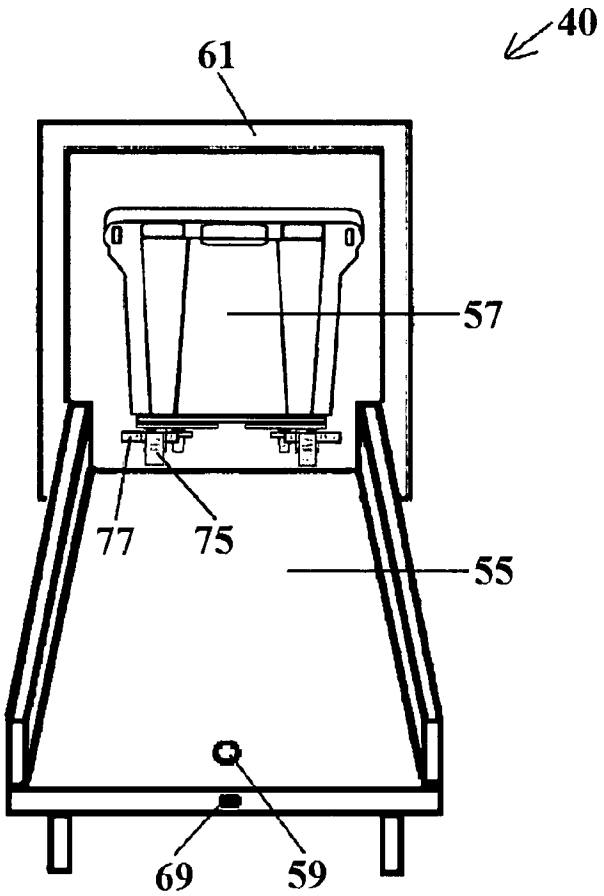
FIG. 3B shows the same structure as FIG. 3A, but with the storage bin now inside the opening and on the set of tracks.
Figure 3A:
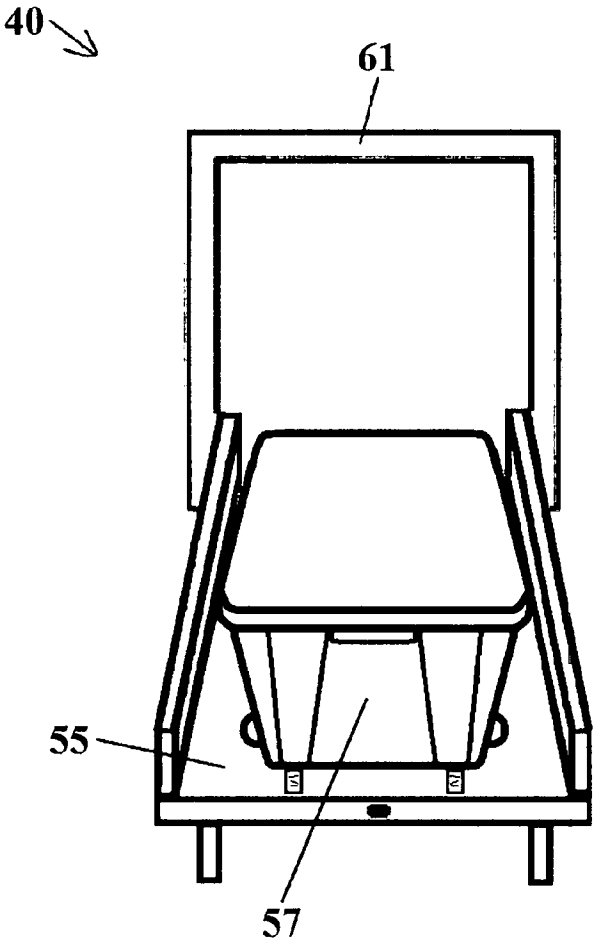
FIG. 3A illustrates a front view of a single storage pathway (set of tracks and drop down gate) of a present invention multitrack storage system, with a storage bin positioned on the open drop down gate.
Figure 3D:
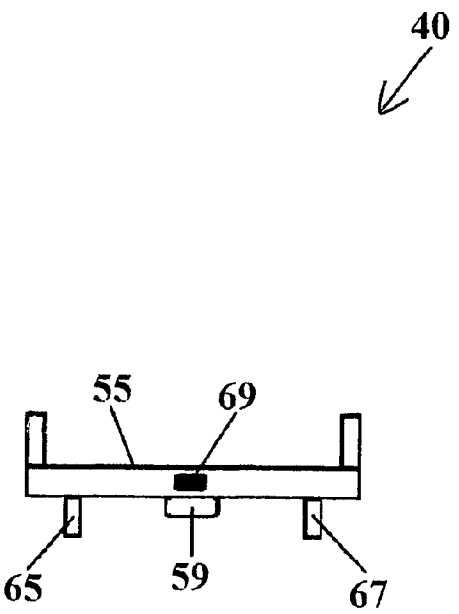
FIG. 3D shows a top view of only the drop down gate that is shown in FIGS. 3A, 3B, and 3C.
Figure 3C:
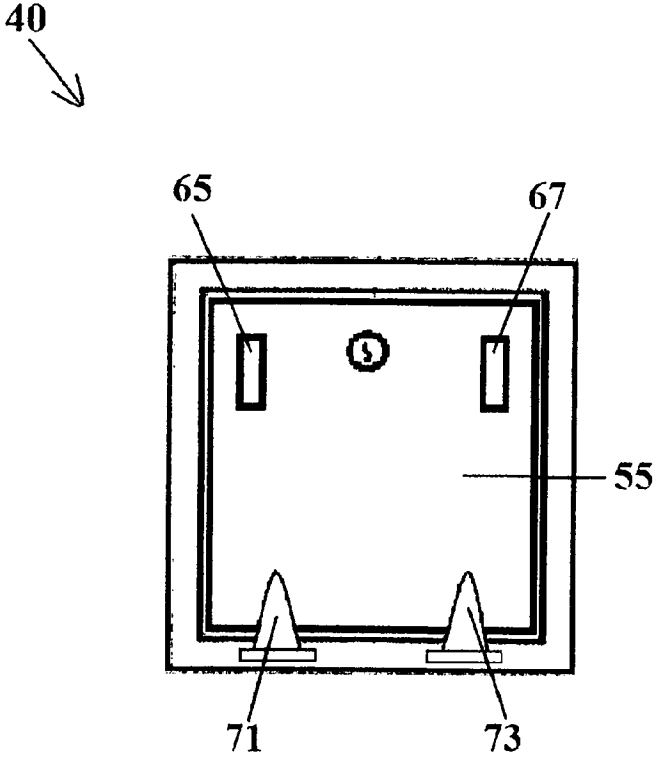
FIG. 3C shows the same illustration as FIG. 3B, but with the drop down gate in a closed and locked position.

FIG. 3A illustrates a front view of a single storage pathway 40 (set of tracks and drop down gate) of a present invention multitrack storage system, with a storage bin 57 positioned on the open drop down gate 55 attached to frame 61. FIG. 3B shows the same structure as FIG. 3A, but with the storage bin 57 now inside the opening (in storage) and on the set of tracks (which are further detailed in FIGS. 6 and 9 through 13). Also shown in FIG. 3B on drop down gate 55, are lock mechanism 59 and latch 69. Frame 61 has a corresponding latch receiver (not shown). Bin 57 includes bottom wheels, such as wheel 75 and side bumper wheels, such as wheel 77. FIG. 3C shows the same illustration as FIG. 3B, but with the drop down gate 55 in a closed and locked position. Handles 65 and 67 and hinges 71 and 73 enable drop down gate 55 to be opened as shown in FIG. 3B. FIG. 3D shows a top view of only the drop down gate 55 that is shown in FIGS. 3A, 3B, and 3C. Identical parts are selectively identically numbered in FIGS. 3A, 3B, 3C and 3D.

Figure 4:
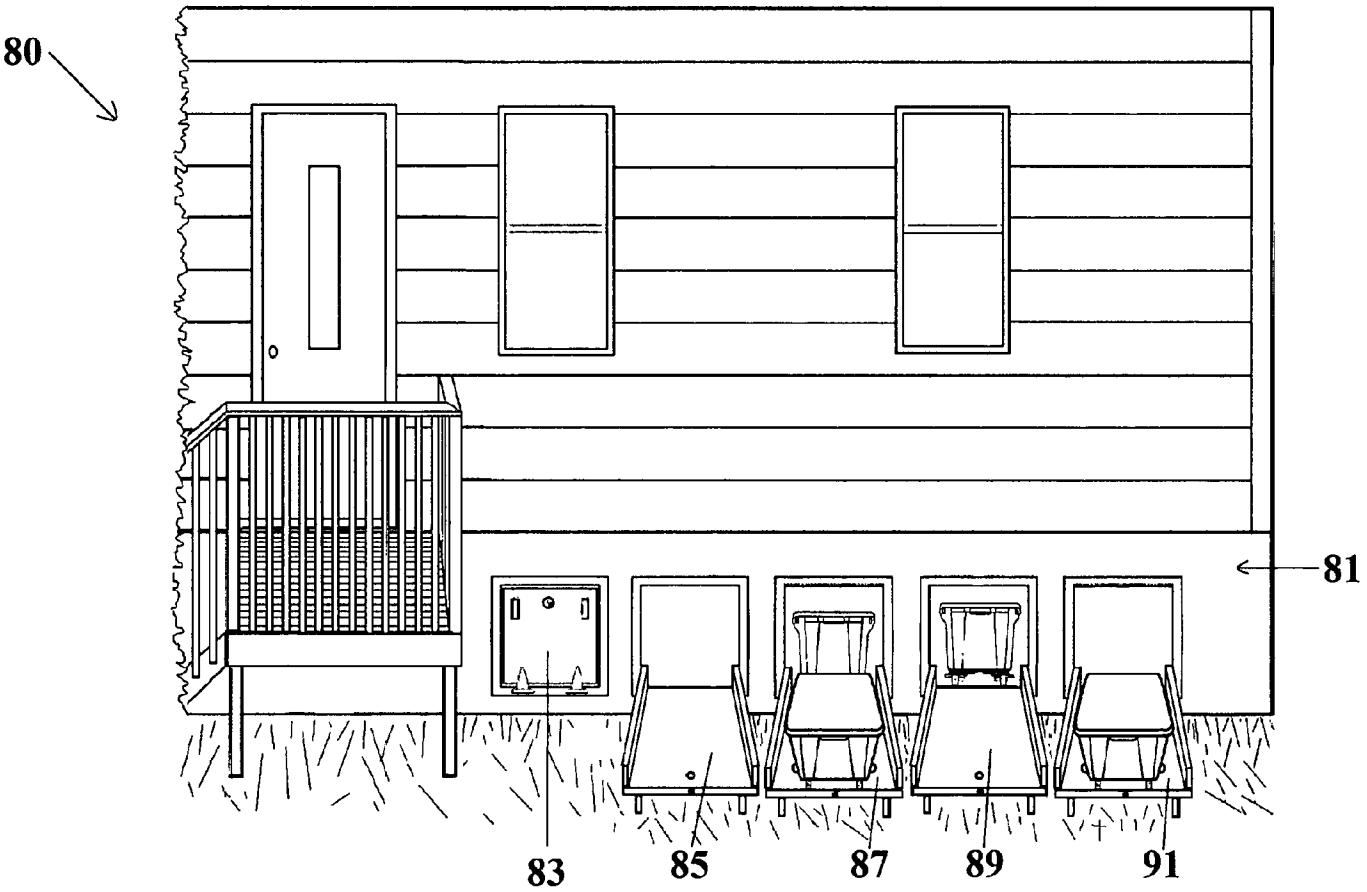
FIG. 4 shows a partial front view of a mobile home with an arrangement of five drop down gates and sets and tracks of a present invention multitrack storage system.

FIG. 4 shows a partial front view of a mobile home 80 with an arrangement of five drop down gates 83, 85, 87, 89 and 91, on wall 81, with sets of tracks of a present invention multitrack storage system inside. House trailer 80 typically will have an open bottom or temporary or permanent enclosure walls and which of these may be the case, new walls or old walls must be created with openings and frames to receive the sets of tracks. The tracks may be laid down on the ground, on a support pad such as a concrete or blacktop or other pad or base, or on flooring if such exist individual storage bin are in and out as needed. While FIG. 4 shows the present invention storage system at the front of the house trailer 80, the system may very well be installed at one or both ends of the trailer as illustrated in FIG. 5.

Figure 5:
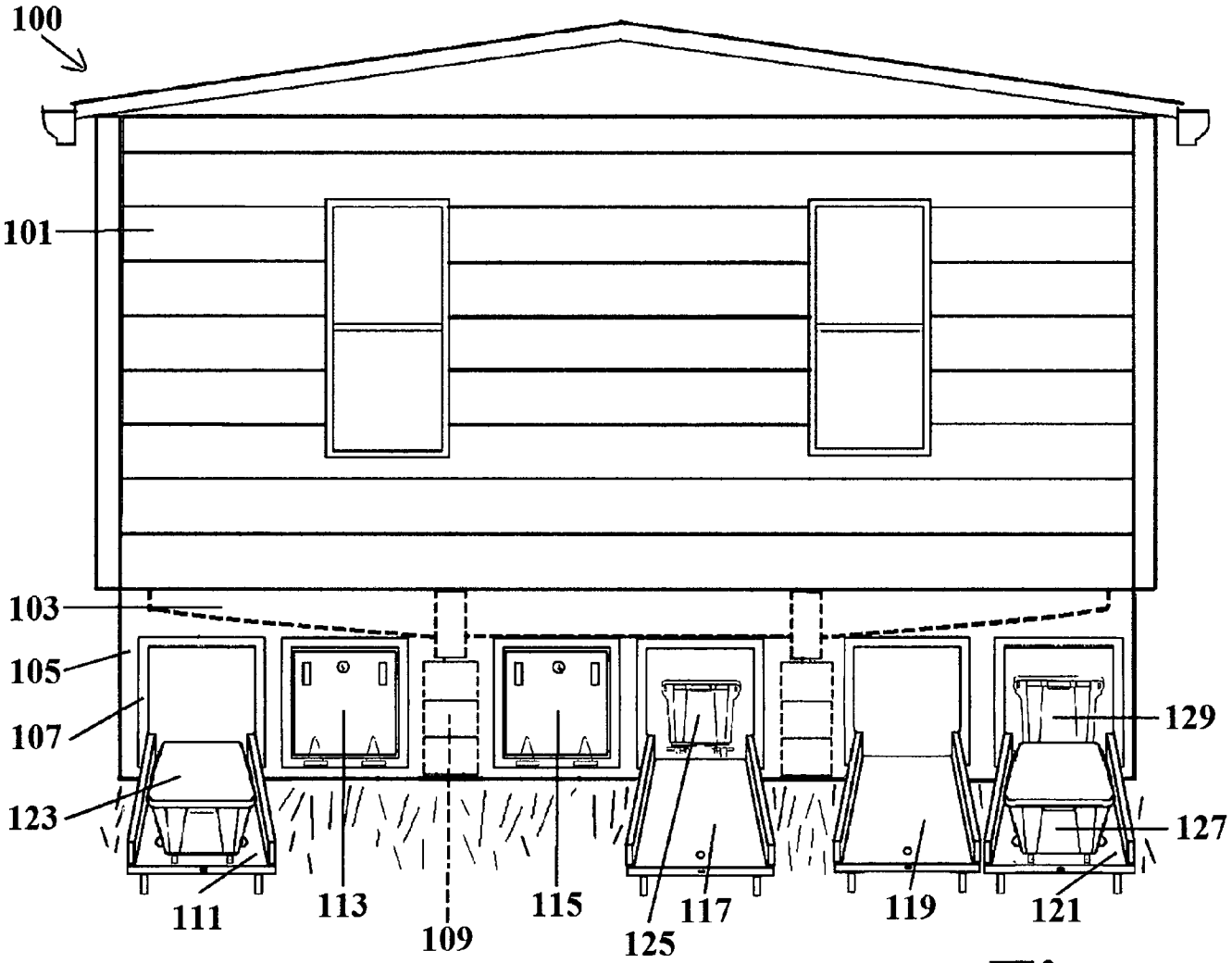
FIG. 5 shows a present invention multitrack storage system located at an end of a mobile home (end would be the back end or front end based on the manner in which it is towed, whereas, when a mobile home is set down on a permanent pad, an end would be on the left side or right side of the mobile home relative to the front door)

FIG. 5 shows a present invention multitrack storage system located at an end 101 of a mobile home 100 (end would be the back end or front end based on the manner in which it is towed, whereas, when a mobile home is set down on a permanent pad, an end would be on the left side or right side of the house relative to the front door). This particular mobile home 100 has a main set of support beams (two in this drawing) with joists such as joist 103, supported by columns, such as column 109. Protective wall 105 has 6 framed openings, such as opening 107 to receive drop down doors and tracks inside. Here, there are 6 different sets of drop down gates in groups of twos between the support columns. They are gates 111, 113, 115, 117, 119 and 121. Bins, such as bins 123, 125, 127 and 129 are in various stages of use, as shown. These are more fully described in the parent application hereto and below, but include side wheels referenced as bumper wheels, and bottom wheels referenced as ground wheels. The bumper wheels may glade along the vertical or near vertical side rails of the tracks.

Figure 6:
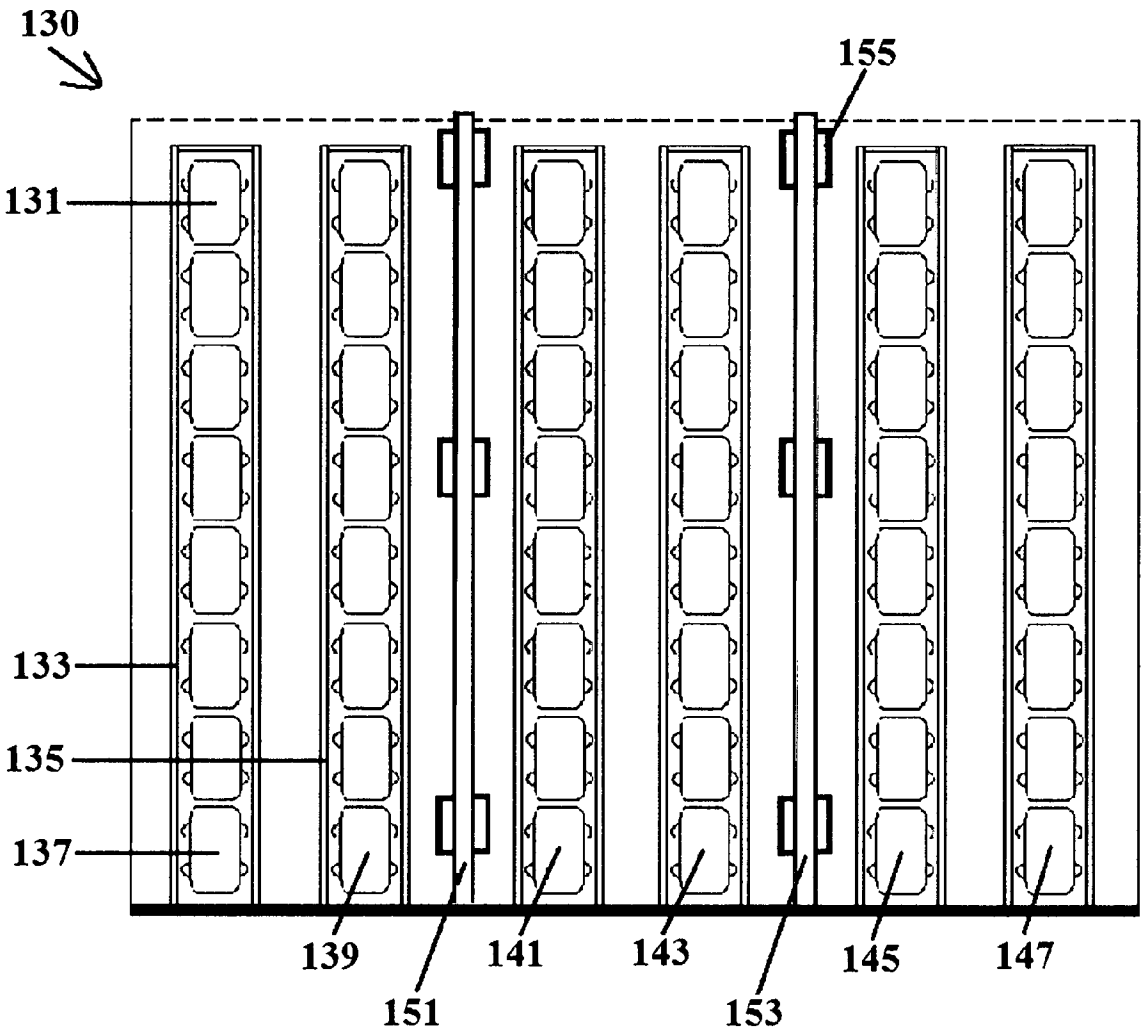
FIG. 6 illustrates a top view of a plurality of parallel sets of tracks in a present invention multitrack storage system.

FIG. 6 illustrates a top view of a plurality of parallel sets of tracks in a present invention multitrack storage system 130. This multitrack storage system 130 is shown with two support beams 151 and 153 with columns, such as 155, and could be the footprint of a present invention system, such as shown in FIG. 5. The 6 sets of tracks, such as 133 and 135 are shown as single piece straight tracks, but could be multiple joined sections and are not required to be straight. The storage bins are lined like trains and in some cases could be linked or connected to one another or may be stand alone units. On track 1 are end-bin 131 and start bin 137. Other illustrative bins 139, 141, 143, 145 and 147 could likewise be attached or detached. When they are attached, they may be removed sequentially and inserted sequentially, by gravity (sloped) and/or with a rope or other movement mechanism. These mechanisms enable users to storage greater numbers of bins into deeper storage areas without having to crawl into the storage areas to access the bins.

Figure 7:
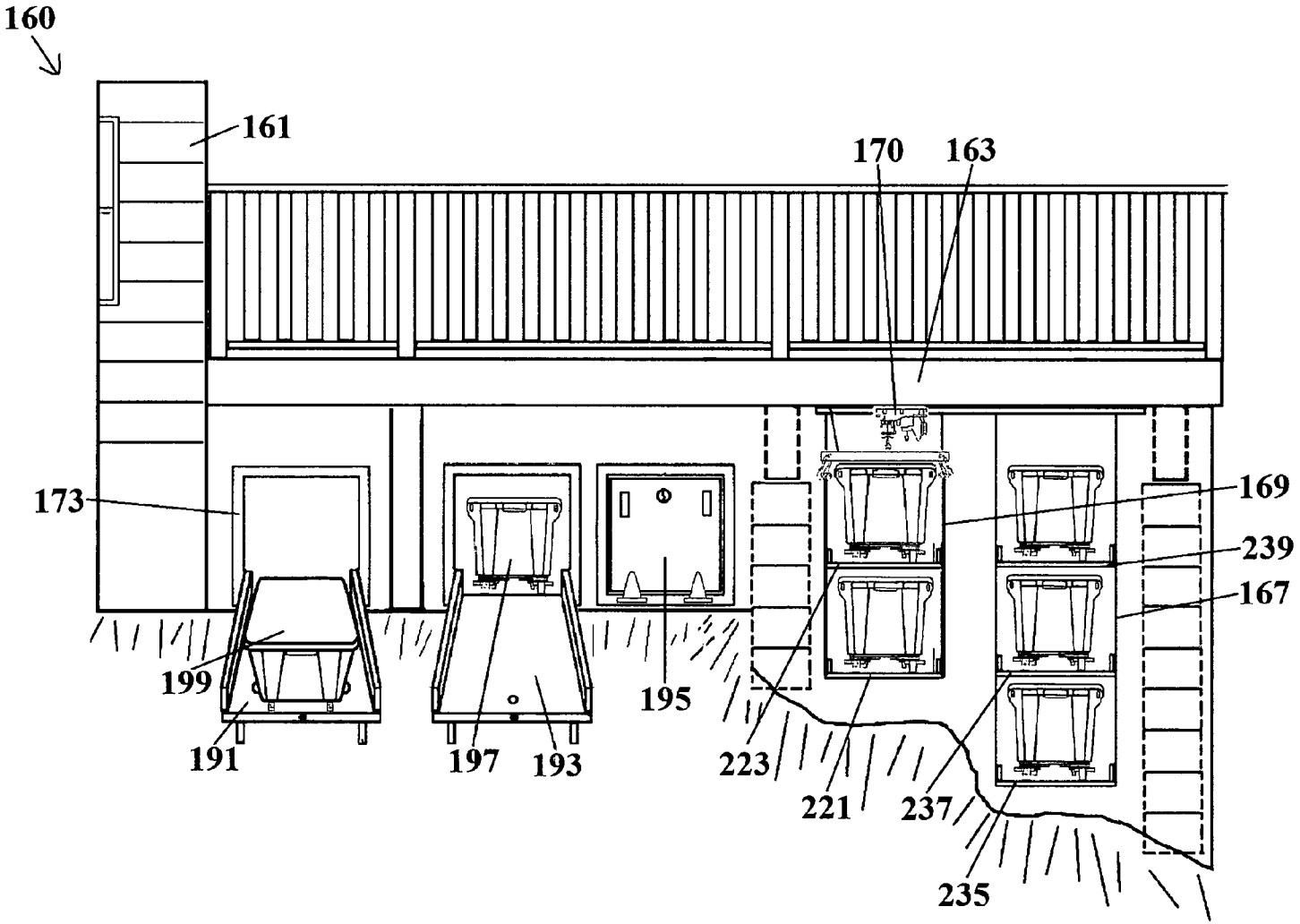
FIG. 7 shows a side view of a multilevel track system of the present invention multitrack storage system with a lift under a deck

FIG. 7 shows front view of a multilevel track system of the present invention multitrack storage system 160 with a lift 170, and positioned under a deck 163 of house 161. Here, on the left portion under deck 163, are openings such as storage openings, defined, for example, by frame 173. Each of the three frames shown has its own track therein for storage of bins, such as bins 199 and 197. Drop down gates (with rails) 191, 193 and 195 are shown with two open and one closed, and are the same as those described above. As deck 163 is positioned on a slope that slopes down and away from house 161, the height thereunder increases, enabling stacking of tracks. Thus track 223 is stacked above track 221 and both are connected to a suspension system 169, as shown, hanging from the underside of the deck. Likewise, tracks 235, 237 and 239 are suspended in stacked fashion, here with suspension system 167. Bins are stored therein as shown.

When present invention systems are installed under decks, certain modifications may be required. For example, the deck preferably has a waterproof base to prevent rain and melting snow from entering the storage areas. Further, when tracks are stacked, taller gates, roll up doors or regular doors may be needed to lock up the stored items.

Figure 8:
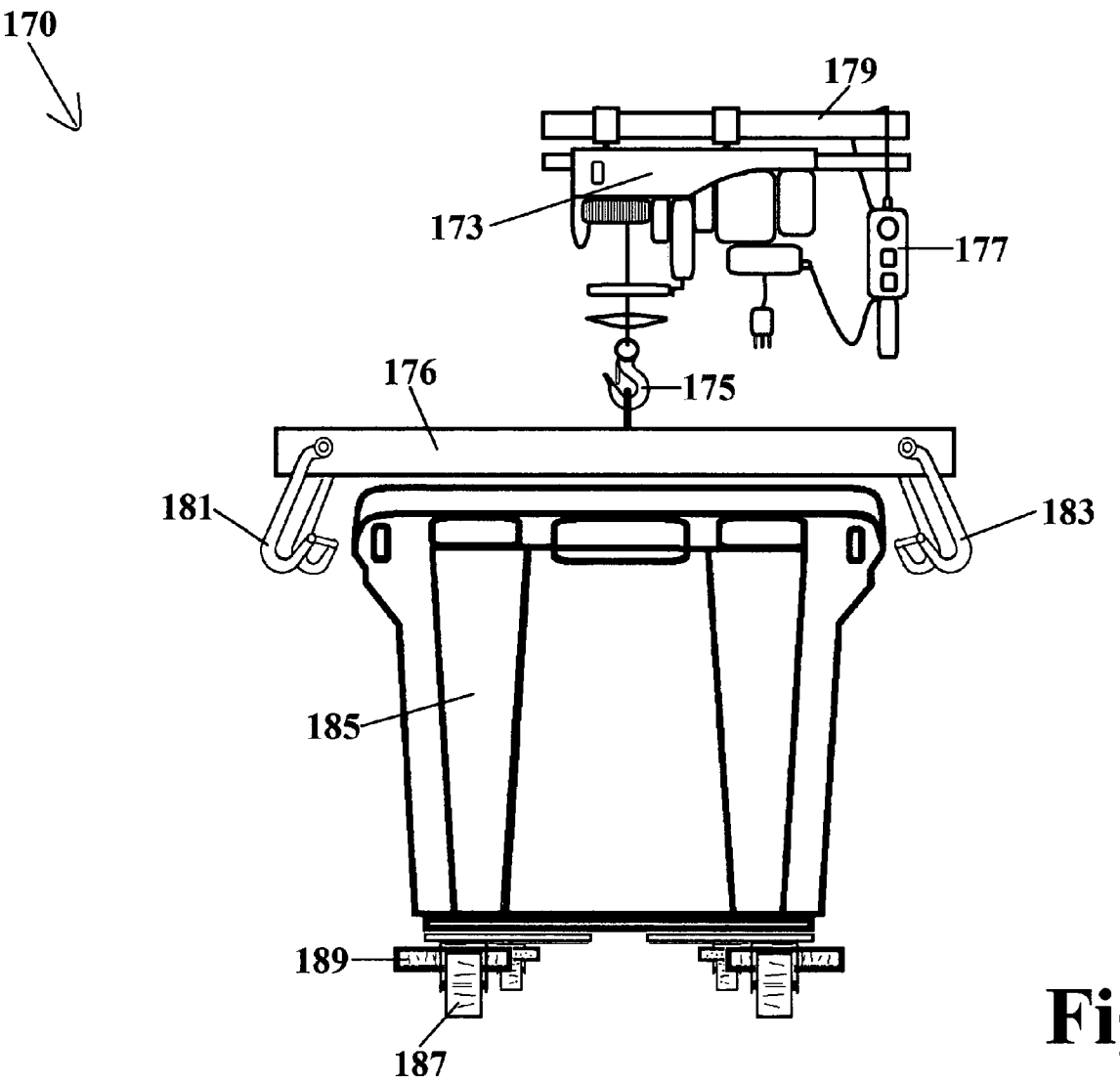
FIG. 8 shows a front view with details of the lift shown in FIG. 7 and being attached to a bin in some preferred embodiments of the present invention multitrack storage system.

FIG. 8 shows a front view with details of the lift 170 shown in FIG. 7 and being attached to a bin 185 for use in some preferred embodiments of the present invention multitrack storage system that have multiple levels, including the embodiment shown in FIG. 7. As can be seen, storage bin 185 has four bottom wheels such as bottom wheel 187, and four bumper wheels, such as bumper wheel 189. As stated, the bottom wheels, inter alia, are used to run the storage bins along the tracks to place them into and to take them out of storage, while the bumper wheels keep the moving bins from side scraping the rails, which are necessary to keep the storage bins efficiently aligned and to keep them from veering off track. The lift 170 is suspended on rail 179 for movement from stack to stack of storage rails and has a hoist motor 173, connected to a hoist line and hook 175, which is removably connected to a bin lift hook assembly. It includes beam 176 and grapple hooks 181 and 183 for attachment to a bin, such as bin 185. When these grapples are attached to bin 185, it may be lifted or lowered by operation of controls 177 to place a bin in line with a track for storage. When a bin is lined up elevationally, a user may push the bin onto a track and remove the grapples, reversing the process for removing bins from (stacked) storage.

Figure 9:
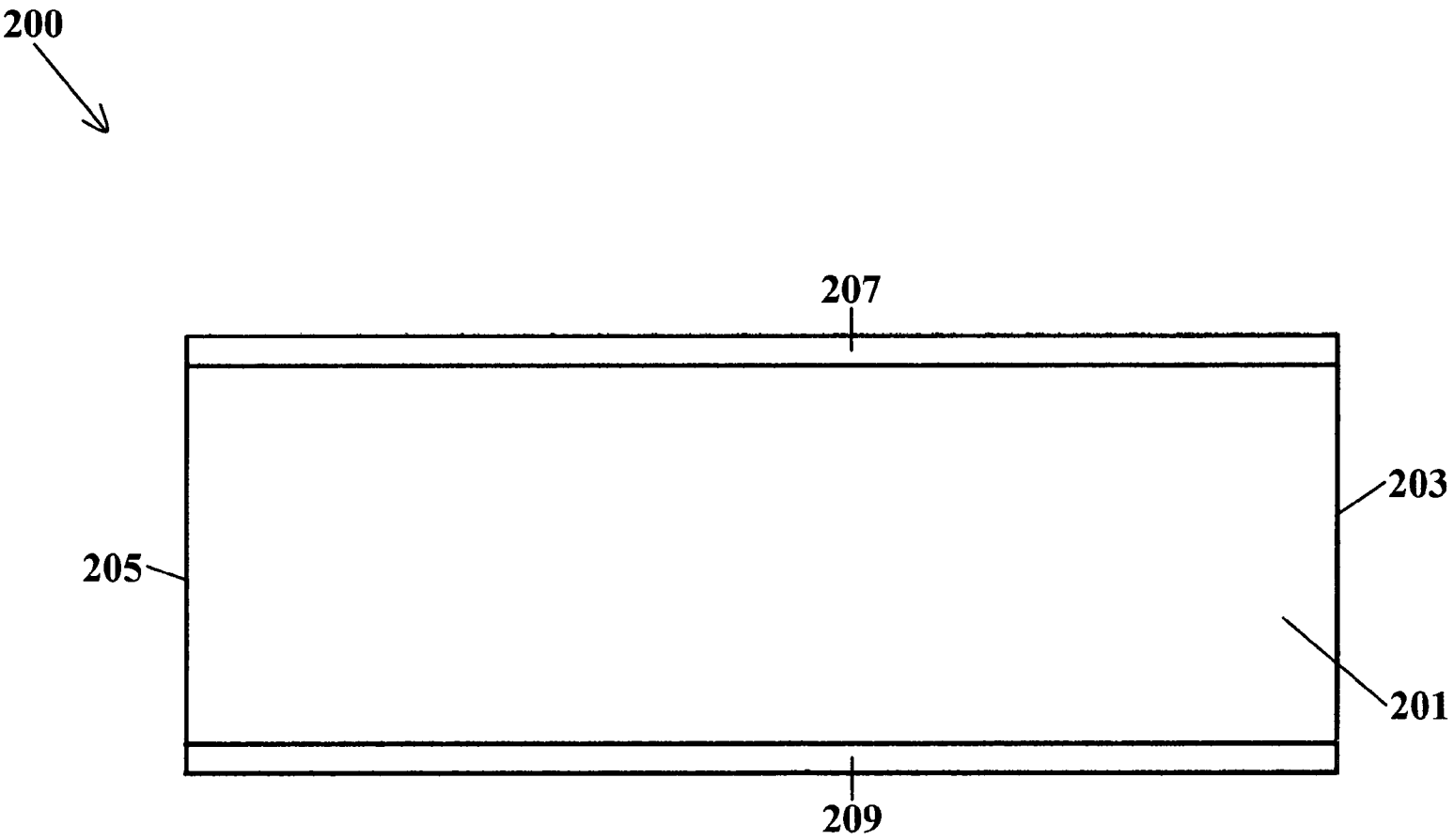
FIG. 9 shows a top view of one example of a pathway track used in the present invention multitrack storage system.
Figure 10:
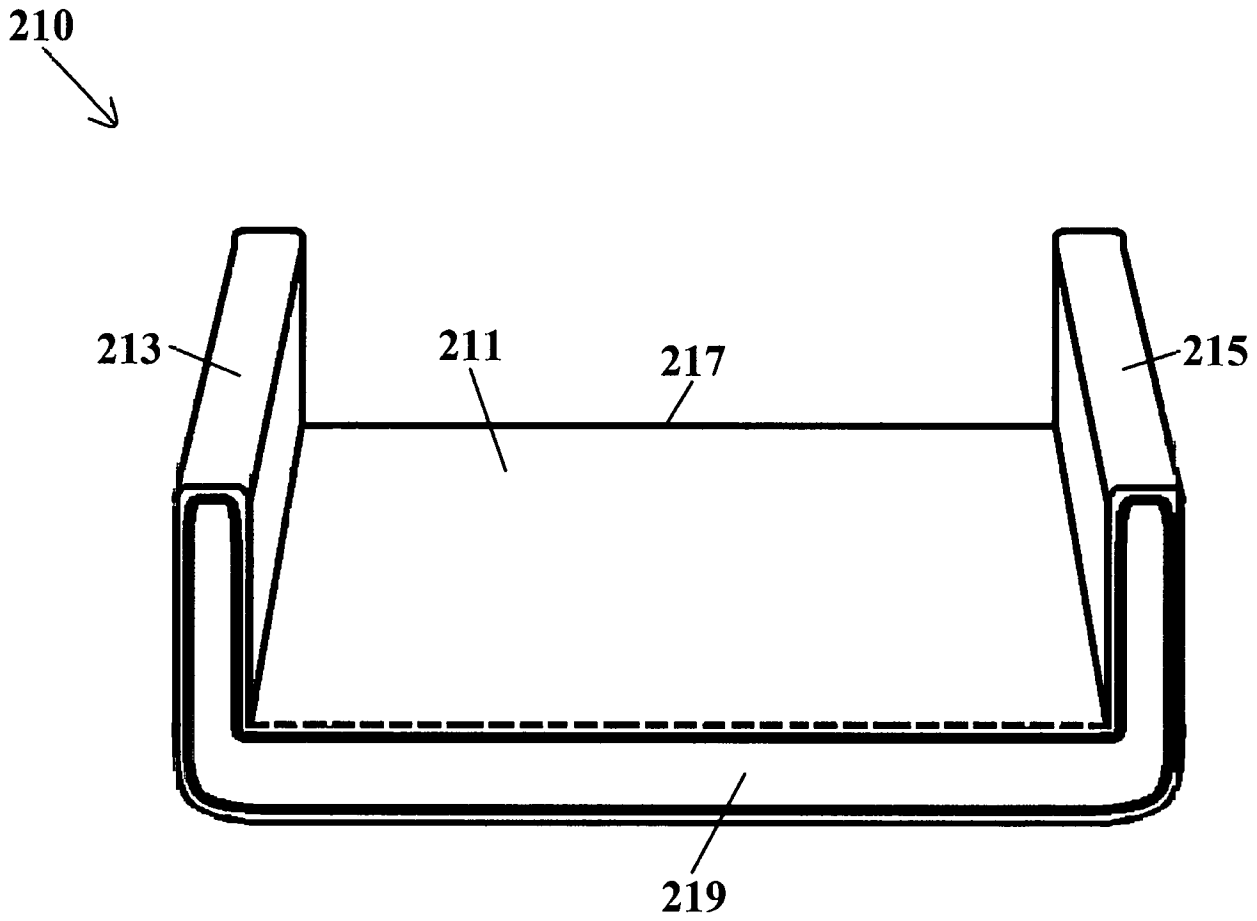
FIG. 10 shows an oblique view of a pathway track connector to align and connect two sections of pathway tracks of the present invention multitrack storage system.
Figure 11:
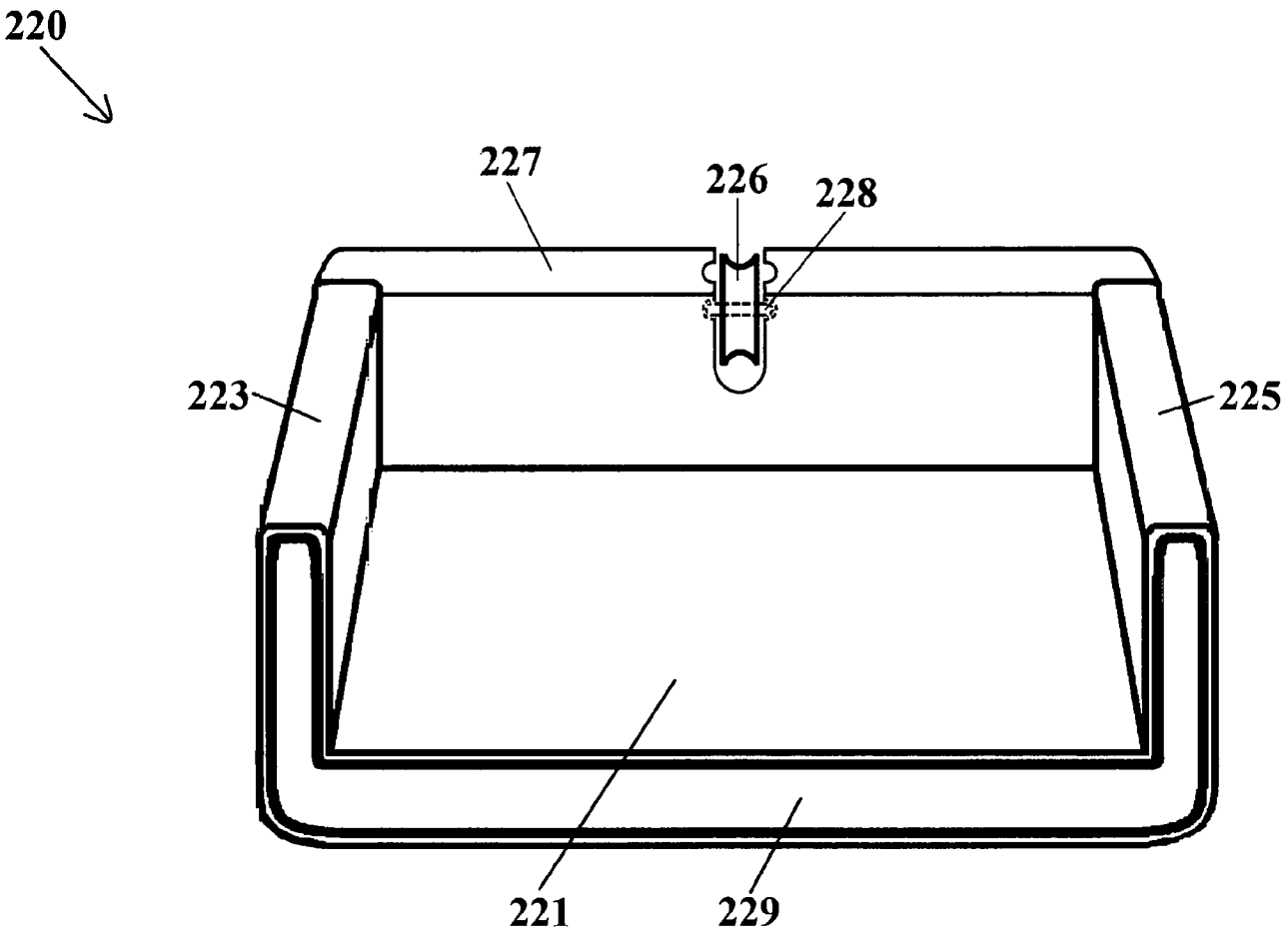
FIG. 11 shows an oblique view of a pathway track distal end terminating bumper for a pathway track of the present invention multitrack storage system.

FIG. 9 shows a top view of one example of a pathway track 200 used in the present invention multitrack storage systems. Track 200 has a base 201 for movement and resting of bins thereon, side rails 207 and 209, and ends 203 and 205 to terminate the track 200 or to attach to other tracks, by connectors or end pieces described in FIGS. 10 and 11. FIG. 10 shows an oblique view of a pathway track connector 210 to align and connect two sections of pathway tracks of the present invention multitrack storage system. Connector 210 has a hollow track receiving slot 219 that extends through end 217, top riding surface base 211 and side rail receivers 213 and 215. FIG. 11 shows an oblique view of a pathway distal terminating bumper 220 for a pathway track of the present invention multitrack storage system. Distal terminating bumper 220 has a base 221, side rails 223 and 225 and backstop 227. It has a hollow area 229 for receiving an end of a track such as end 203 and side rails 207 and 209 of track 200 shown in FIG. 9. In this embodiment, there is a pulley 226 on axle 228, for assisting in the movement of plural bins, as described in more detail in FIGS. 12 and 13.

Figure 12:
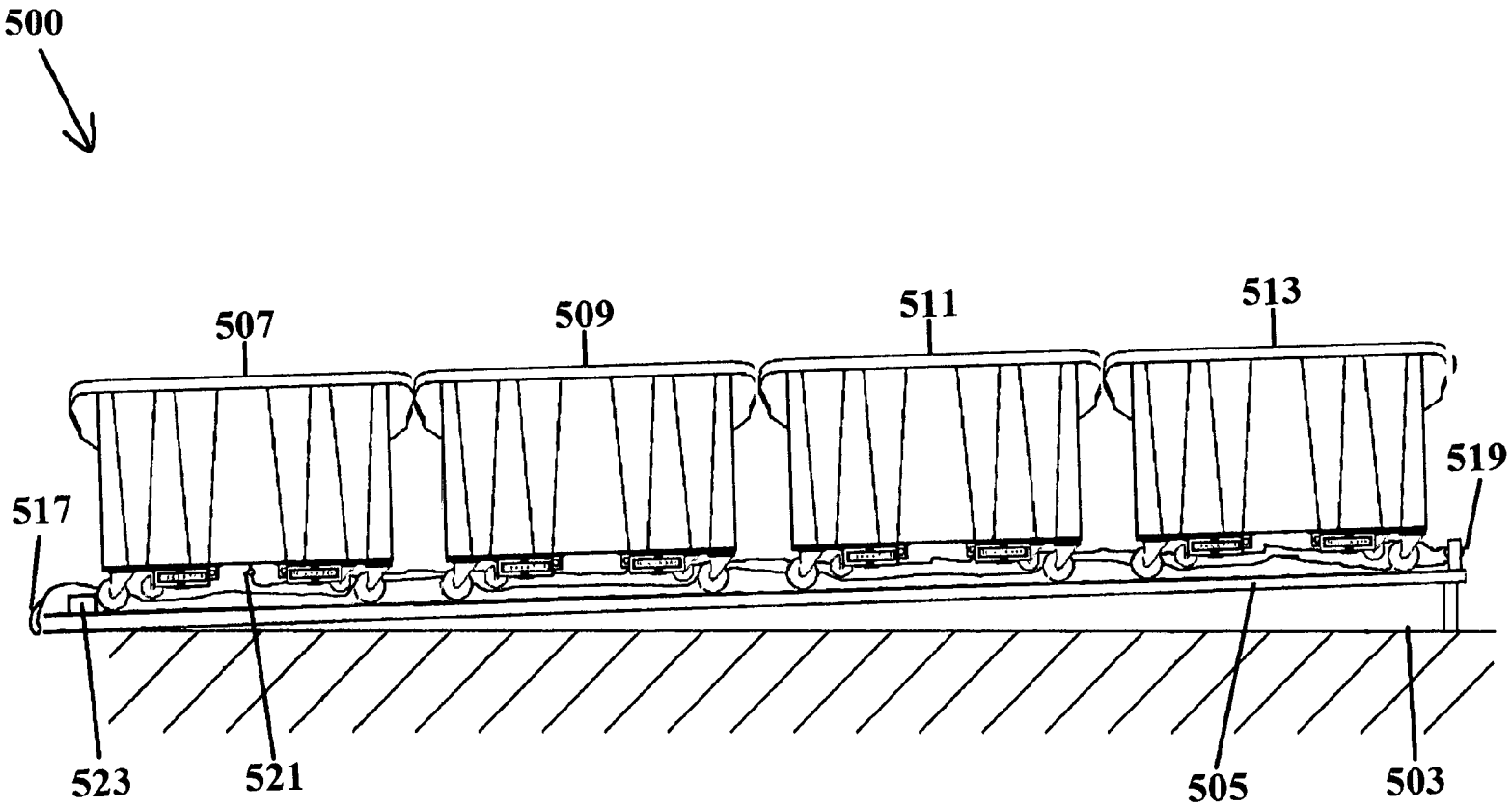
FIG. 12 shows a bin movement mechanism for tracks where a portion of the pathway system slopes upwardly away from the proximal end and downwardly away from the distal end of a present invention multitrack storage system; and, FIG. 13 shows a bin movement mechanism for tracks where a portion of the pathway system slopes downwardly away from the proximal end and upwardly from the distal end of a present invention multitrack storage system.
Figure 13:
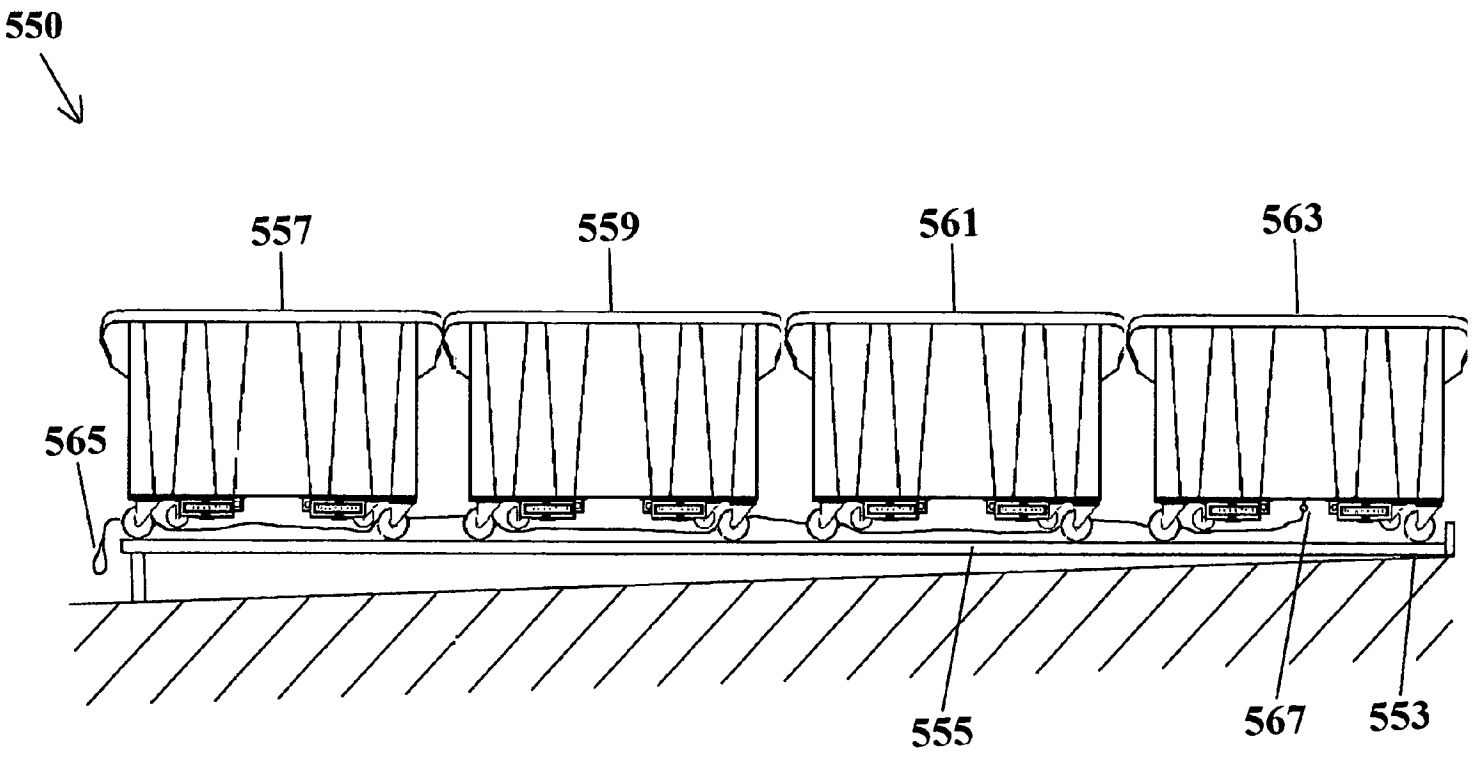

FIGS. 12 and 13 show bin movement mechanisms for tracks of present invention systems, sloped upwardly away and downwardly away, respectively, from the proximal end of the tracks. In FIG. 12, present invention system 500 is shown in part (drop down gate and other sets of tracks not included) and rests on floor 503. It includes a plurality of track sections shown simplistically as a single elongated track 505. It is sloped upwardly away from the proximal end (left in the figure) and has wheeled bins 507, 509, 511 and 513 on track 505. These wheeled bins are similar to those described above but contain eyelets on their bottoms such as eyelet 521 on bin 507. Bin 507 is the lead bin and is connected to rope 517 which travels to the distal end, then over pulley 519 and then back to the proximal end of track 505 by lowering (releasing) or pulling on rope 517, a user will move the entire chain of bins up or down track 505. As an alternative, or in addition to the rope, periodic brakes such as, brake 523 may be employed to hold bins in place against gravity. These brakes may be manually operated, mechanically operated or electronically operated. Controls may be mechanically linked, wired or wireless.

Conversely, in FIG. 13, where a portion of system 550 is shown, track 555 slopes downwardly away from the proximal end, resting on floor 553. Because this is sloped downwardly and away, the eyelet 567 on the most distant bin from the proximal end is connected to the rope 565 and by a user pulling on the rope 565, the entire chain of bins 557, 559, 561 and 563 are pulled toward the proximal end. By releasing the rope 565 slowly, all of the bins will move downhill by gravity toward the distal end.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A multitrack storage system for open crawl space, which compromises:

a) a plurality of different sets of tracks, each of said tracks having a track base and opposing sidewalls for guiding a plurality of separate, wheeled storage bins, wherein each of said tracks constitute a groove having a predetermined width of at least X, wherein X is a width in the range of six inches to five feet, and having connection mechanisms for connecting each of said tracks to one another, said tracks having a proximal end and a distal end;

b) a distal end bumper at the distal end of each of the sets of tracks to prevent off track movement of any of the storage bins that may be moved thereon;

c) said plurality of separate, wheeled storage bins, being positioned on said different sets of tracks, each storage bin having a plurality of bottom wheels and a plurality of side wheels wherein the maximum outside width of said bins, including said side wheels, as measured side to side, is less than X such that said side wheels of said storage bins nest in said tracks, said storage bin side wheels having a vertical axis of rotation within the range of minus 45 degrees to plus 45 degrees, and nesting on said track base;

d) a bin movement mechanism connected to at least one separate, wheeled storage bin for movement thereof;

e) a proximal end for the plurality of different sets of tracks wherein the plurality of different sets of tracks terminate adjacent one another in a predetermined pattern of set of tracks;

f) a plurality of drop down gates for opening and closing access to each of the plurality of different sets of tracks, each of said drop down gates having a front and a back, wherein when each of said drop down gates is closed, it is up and the back faces the plurality of different sets of tracks, and when each of said drop down gates is down and open, the back faces upwardly; the back having a plurality of short tracks, at least a portion, which is in alignment with the predetermined patterns of sets of tracks;

wherein a user may access items into and out of the wheeled storage bins and place said wheeled storage bins on the short tracks of each of said drop down gates, and then move the storage bins along one of the plurality of different sets of tracks away from each of said drop down gates for storage.

2. The multitrack storage system of claim 1 wherein the plurality of different sets of tracks are parallel to one another.

3. The multitrack storage system of claim 1 the storage system pattern includes a tilting mechanism in contact with at least a portion of the tracks, the tilting mechanism establishing an angle of the tracks to a non-horizontal position.

4. The multitrack storage system of claim 1 wherein the tracks have vertical sidewalls.

5. The multitrack storage system of claim 1 wherein the wheeled storage bins include lids.

6. The multitrack storage system of claim 1 wherein the tracks are structurally formed of materials selected from the group consisting of wood, metal, plastic and combinations thereof.

7. The multitrack storage system of claim 1 wherein the bin movement mechanism includes at least one flexible cord having a distal end away from the drop down gate and a proximal end at the adjacent drop down gate.

8. The multitrack storage system of claim 7 wherein each storage bin has a distal end away from the drop down gate and a proximal end closest to the drop down gate, and the at least one flexible cord is connected to the distal end of the bin and there is a pulley at the distal end of the track whereby the cord travels from the distal end of the storage bin to the pulley and then returning to the drop down gate.

9. The multitrack storage system of claim 7 wherein each storage bin has a distal end away from the drop down gate and a proximal end closest to the drop down gate, and the at least one flexible cord is connected to the proximal end of the bin and travels from the proximal end of the storage bin to the drop down gate.

10. A multitrack storage system of claim 1 wherein said storage bin side wheels have a vertical axis of rotation within the range of minus 20 degrees to plus 20 degrees.

11. The multitrack storage system of claim 10 wherein the storage bin side wheels have a vertical axis of rotation.

12. The multitrack storage system of claim 1 wherein the bin movement mechanism is a motorized bin movement mechanism.

13. The multitrack storage system of claim 12 wherein the motorized bin movement mechanism is wirelessly operable.

14. The multitrack storage system of claim 1 wherein the plurality of different sets of tracks includes at least one set of tracks at a first level, being a first floor level, and at least one set of tracks at a second level, being a second floor level.

15. The multitrack storage system of claim 14 wherein the multitrack storage system further includes at least one bin transporting elevator lift to move the storage bins from the first floor level to the second floor level and vice versa.

16. The multitrack storage system of claim 15 wherein the elevator lift is laterally moveable from one set of tracks to another set of tracks.

* * * * *